US005226750A

United States Patent [19]

Meheen

[11] Patent Number: 5,226,750

[45] Date of Patent: Jul. 13, 1993

[54] OFFSHORE DRILLING PLATFORM SUPPORT

[76] Inventor: H. Joe Meheen, 1860 Lincoln St., Suite 1026, Denver, Colo. 80295

[21] Appl. No.: 908,352

[22] Filed: Jul. 6, 1992

[51] Int. Cl.[5] ..... E02B 17/02

[52] U.S. Cl. ..... 405/207; 405/211; 405/227

[58] Field of Search ..... 405/195.1, 203, 204, 405/205, 207, 211, 217, 227

[56] References Cited

U.S. PATENT DOCUMENTS 3,624,702 11/1971 Meheen ..... 405/227
3,886,753 6/1975 Birdy et al. ..... 405/207
3,914,947 10/1975 Lamy ..... 405/207
4,087,984 5/1978 Mo ..... 405/207
4,655,642 4/1987 Birdy et al. ..... 405/217
4,711,601 12/1987 Grosman ..... 405/204
4,906,138 3/1990 Barbaras et al. ..... 405/211

*Primary Examiner*—David H. Corbin
*Attorney, Agent, or Firm*—Richard W. Hanes

[57] ABSTRACT

An improved columnar support for offshore drilling platforms intended for installation in a body of water such as the ocean, comprising a cylindrical shaft of unitary cemetitious construction, a frustrum shaped hollow capital having a first peripheral flange, a frustrum shaped hollow base having a second peripheral flange and seals, which may include removable plugs in the open ends of the capital and the base for creating a scuttle opening therein to admit water and sink the columnar support at a designated position on the sea floor.

4 Claims, 3 Drawing Sheets

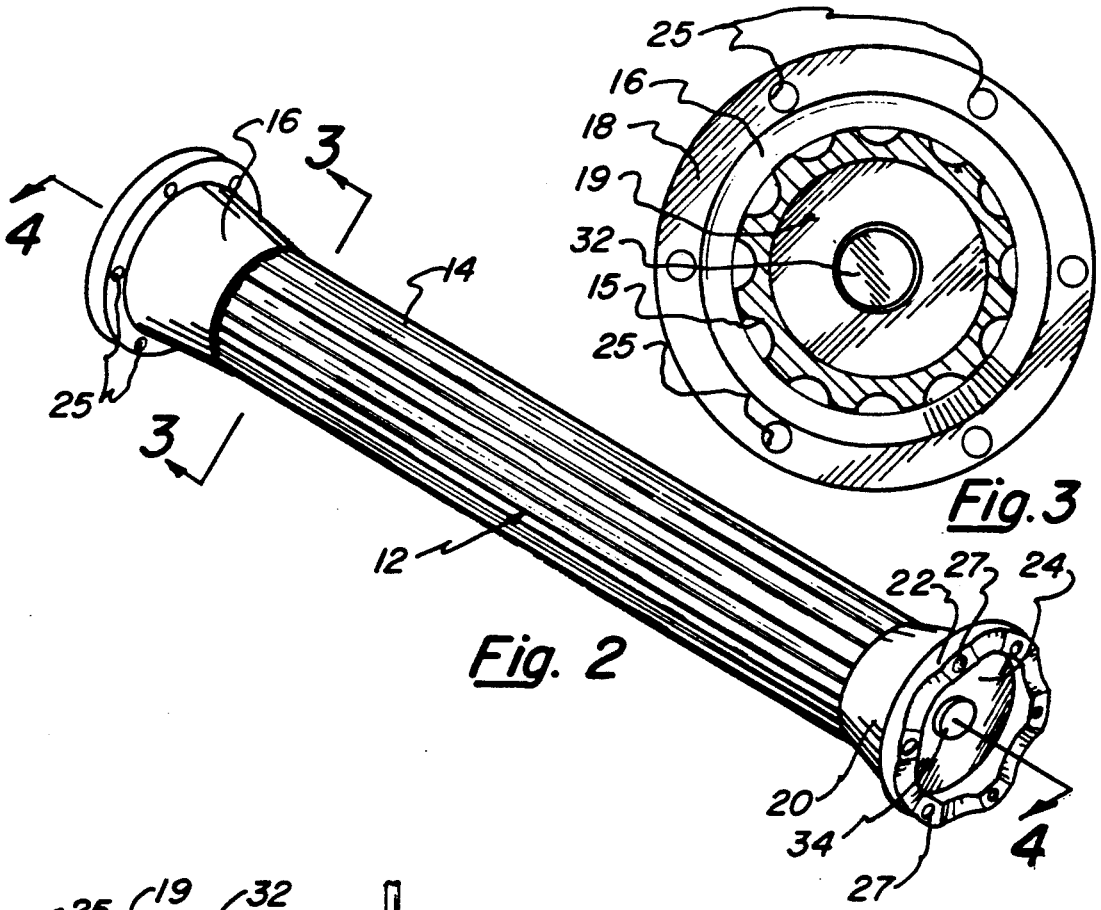
Fig. 3
Fig. 2
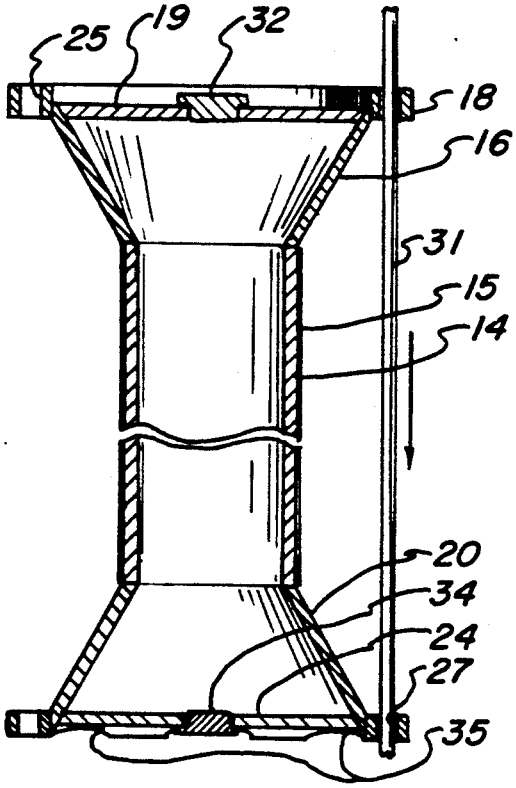
Fig. 4

OFFSHORE DRILLING PLATFORM SUPPORT

The present invention relates generally to a support for an offshore drilling platform and represents an improvement over the platform support disclosed in my previously issued U.S. Pat. No. 3,624,702.

BACKGROUND OF THE INVENTION

The prior art, as represented by the aforesaid previously issued patent, contemplates an offshore drilling platform support comprising a single prestressed concrete column formed of stacked annular segments and having top and bottom segments carrying radial ribs, the lower of which serves to stabilize the column on the sea bottom while the ribs protruding from the top segment serve to support the structure comprising the drilling platform. Vertically aligned holes int he upper and lower ribs provide guidance sleeves for the anchoring piles which are driven into the sea floor.

To fabricate or assemble the column, the various segments are attached together at sea on a construction barge, a limiting and inconvenient aspect of the precast concrete column concept.

The primary object of the improvement comprising the present invention is to provide a light weight offshore platform support column of the same general nature as that previously disclosed but which is now designed to be fully fabricated on shore, easily placed into the sea and then towed to the location for its final installation.

DESCRIPTION OF THE DRAWINGS

FIG. 2 is a perspective view of the platform support of the present invention.

FIG. 3 is a cross-sectional view of the support taken along lines 3—3 of FIG. 2.

FIG. 4 is a cross-sectional view of the support taken along lines 4—4 of FIG. 2 and showing an exemplary piling positioned in the vertically aligned holes in the top and bottom flanges.

DETAILED DESCRIPTION OF THE INVENTION

Figure 1:
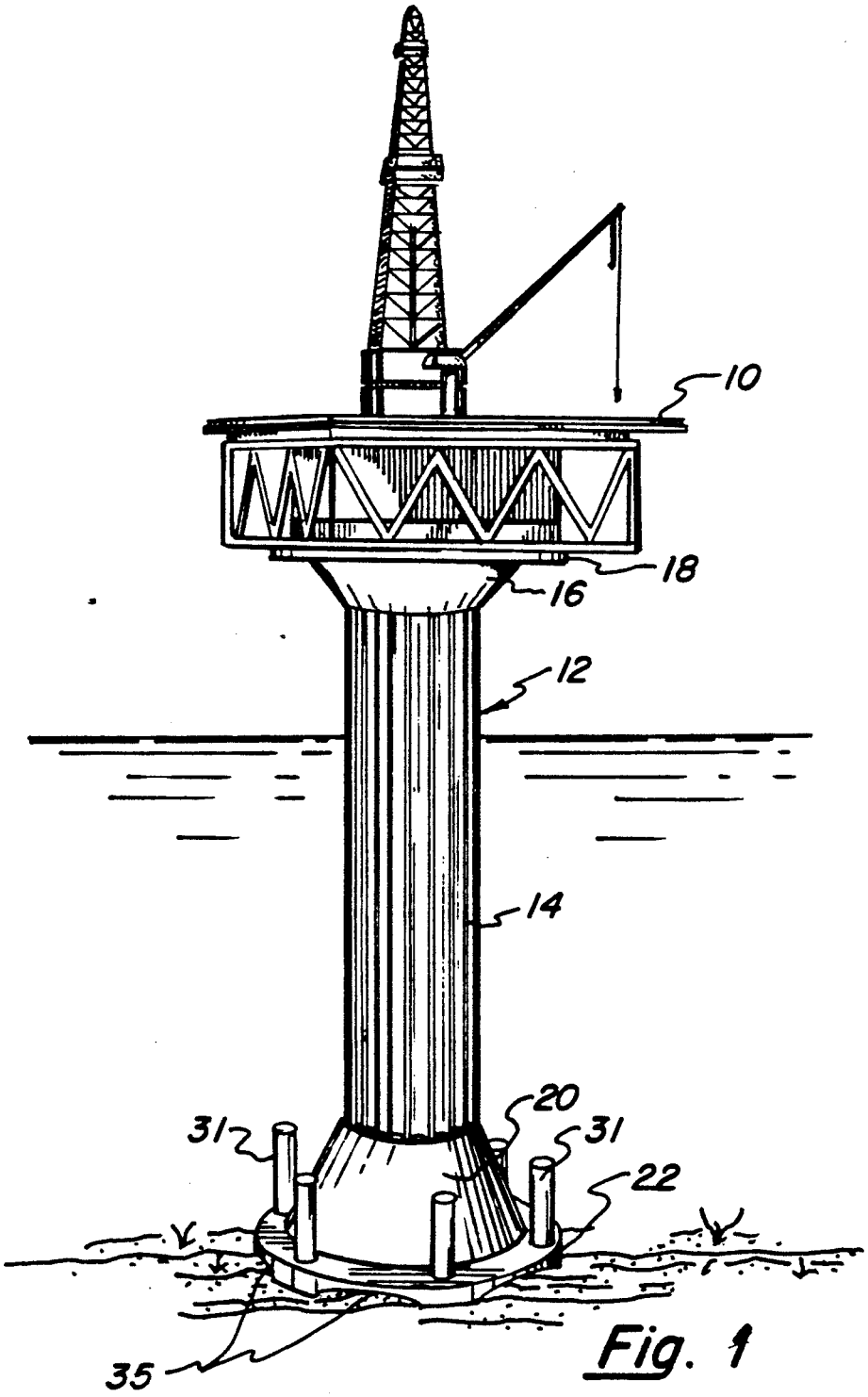
FIG. 1 is a perspective view of an off-shore drilling platform which includes a platform support constructed in accordance with the instant invention.

An offshore drilling platform 10 having a columnar support 12 constructed in accordance with the present invention is illustrated in FIG. 1.

The columnar support 12 comprises a shaft 14 which is substantially cylindrical in its cross section except for the exterior fluting 15. Between the top of the shaft 14 and the drilling platform 10 is a hollow frustrum shaped capital 16 having a peripheral flange 18 which forms the boundary of a planar covering 19. The base of the column is formed of a hollow frustrum shaped segment 20 having a peripheral flange 22 and a planar floor 24. The fluting is provided for additional columnar strength in addition to its ice breaking and wave energy dissipation functions. The column may preferably be constructed of concrete.

The top and bottom flanges 18 and 22 are each provided with vertically aligned and spaced apart holes 25 and 27 respectively. After the column is lowered to its position and made vertically erect, pilings 31 are placed into the aligned holes 25 and 27 and driven into the sea floor in order to anchor the platform in position. The top flange holes 25 serve as sleeve guides for the driving of the piles until the piles are substantially implanted in the sea floor, then the piles may be driven on through the top flange holes 25 and down to a level near the bottom flange holes 27 or they may be cut off along a plane proximate to the bottom flange 22.

Figure 5A:
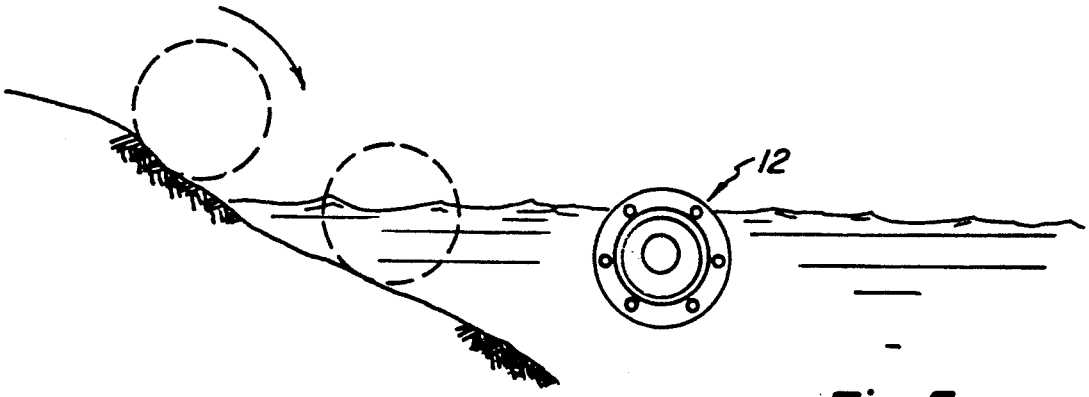
FIG. 5*a* is a diagrammatic view showing the support end view as it would be rolled down a slope into the water.

The circular perimeter of the frustrum flanges 18 and 22 provides novel implications for the problems of moving the heavy column from its fabricating location to the sea. Preferably, the construction of the support 12 would be done at a site slightly elevated from and close to the shore where, after the support is completed it can be rolled into the sea, as shown in FIG. 5*a*, using the peripheral flanges 18 and 22 as rolling rims which support the column shaft 14 as an "axle".

Figure 5B:
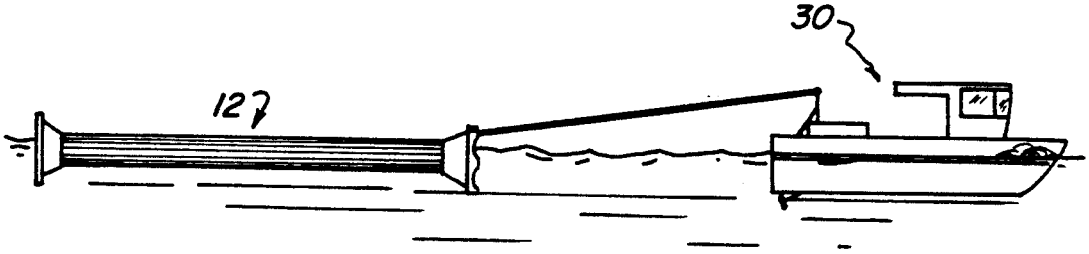
FIG. 5*b* is a diagrammatic side view of the support of the present invention in tow behind a tugboat.

Once in the water, the top covering 19 and bottom floor 24 prevent the entry of water into the interior of the support, making it buoyant enough to be towed on the surface of the ocean by a tug 30, as shown in FIG. 5*b*.

Figure 5C:
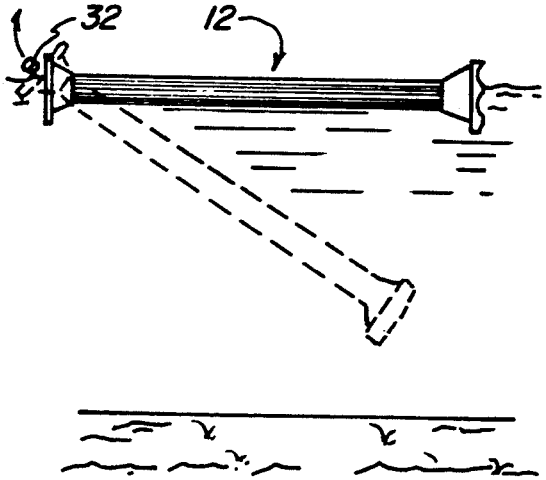
FIG. 5*c* is a diagrammatic side view of the support showing the removal of the top end plug with a sequential position of the column shown in dotted lines as water fills the column to sink it bottom first so as to achieve an upright position on the ocean floor.
Figure 5D:
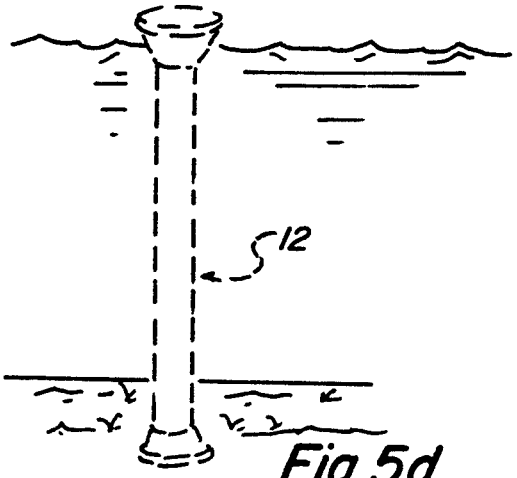
FIG. 5*d* is a diagrammatic side view of the support in an upright position on the ocean floor.

Plugs 32 and 34 are disposed respectively in the top covering 19 and the bottom floor 24. These plugs are removed sequential when the support is sited at its erection location in order to allow the column to fill with sea water and sink, as shown in FIG. 5*c*. If the topmost plug 32 is removed first water will flood the interior of the column, going toward the bottom portion and the bottom will sink first, establishing the proper position of the support on the ocean floor. The lower plug may be removed if necessary to complete the flooding operation. The former necessity for providing a substantially flat area on which the support may rest on the sea floor is less rigorous with the instant support than with the prior art models. The bottom surface of the lower flange 24 is scalloped or intermittently relieved, as at 35, in order to better accommodate the irregularities of the drifting sands of the sea floor.

Although not shown, the risers and conduits from the wells are intended to pass through the interior of the support structure, as in the prior art, penetrating both the floor 24 and the top covering 19 through the use of plugs or valves.

I claim:

1. A columnar offshore drilling platform support for installation in a body of water, comprising, a cylindrical shaft of unitary cemetitious construction, a frustrum shaped hollow capital having at least one open end, a frustrum shaped hollow base having at least one open end, means sealing the open ends of the capital and the base, at least one of which sealing means includes a removable plug for creating a scuttle opening therein and wherein the capital includes a first peripheral frustrum flange, said first flange having a continuous circular outer edge forming the first flange perimeter, and wherein the base includes a second peripheral frustrum flange, said second flange having a continuous circular outer edge forming the second flange perimeter, said first and second peripheral frustrum flanges being sized to allow the support to be rolled on said frustrum flanges in forward direction.

2. The support of claim 1 and further including longitudinal surface fluting carried by the shaft for wave breaking, ice breaking and wave energy dissipation.

3. The support of claim 2 and further including a plurality of vertically aligned holes in the first and second flanges for receiving and guiding anchor pilings.

4. The support of claim 3 where the bottom surface of the second flange is scalloped to accommodate uneven ocean floor surfaces.

* * * * *